US009291350B2

(12) United States Patent
Melton et al.

(10) Patent No.: US 9,291,350 B2
(45) Date of Patent: Mar. 22, 2016

(54) SYSTEM FOR PROVIDING A WORKING FLUID TO A COMBUSTOR

(71) Applicant: General Electric Company, Schenectady, NY (US)

(72) Inventors: Patrick Benedict Melton, Horse Shoe, NC (US); Lucas John Stoia, Taylors, SC (US); Richard Martin DiCintio, Simpsonville, SC (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 520 days.

(21) Appl. No.: 13/845,407

(22) Filed: Mar. 18, 2013

(65) Prior Publication Data

US 2014/0260258 A1 Sep. 18, 2014

(51) Int. Cl.
*F23R 3/26* (2006.01)
*F23R 3/34* (2006.01)

(52) U.S. Cl.
CPC .... *F23R 3/26* (2013.01); *F23R 3/34* (2013.01)

(58) Field of Classification Search
CPC ..... F23R 3/34; F23R 3/286; F23R 3/346; F23R 3/26; F01D 9/023
See application file for complete search history.

(56) References Cited

U.S. PATENT DOCUMENTS

| | | | | | |
|---|---|---|---|---|---|
| 4,006,589 | A * | 2/1977 | Schirmer | F23R 3/26 | 60/39.23 |
| 4,050,240 | A * | 9/1977 | Vaught | F23R 3/26 | 431/352 |
| 4,085,579 | A * | 4/1978 | Holzapfel | F02C 7/08 | 60/39.23 |
| 4,288,980 | A * | 9/1981 | Ernst | F23R 3/002 | 60/39.23 |
| 4,430,860 | A * | 2/1984 | Melchior | F23R 3/26 | 60/606 |
| 4,497,170 | A * | 2/1985 | Elliott | F23R 3/26 | 60/39.23 |
| 4,944,149 | A * | 7/1990 | Kuwata | F23R 3/26 | 60/39.23 |
| 5,557,920 | A * | 9/1996 | Kain | F23R 3/26 | 60/39.23 |
| 2010/0174466 | A1 | 7/2010 | Davis, Jr. et al. | | |
| 2011/0179803 | A1* | 7/2011 | Berry | F01D 9/06 | 60/785 |

* cited by examiner

*Primary Examiner* — Gerald L Sung
(74) *Attorney, Agent, or Firm* — Dority & Manning, PA

(57) ABSTRACT

A system for supplying a working fluid to a combustor includes a fuel nozzle, a combustion chamber disposed downstream from the fuel nozzle, an inner flow sleeve that circumferentially surrounds the combustion chamber and a plurality of injectors circumferentially arranged around the inner flow sleeve. The plurality of injectors provide for fluid communication through the inner flow sleeve and into the combustion chamber downstream from the fuel nozzle. The system further includes an outer air shield that defines an injection air plenum that surrounds the plurality of injectors. An inlet passage extends through the outer air shield to define a flow path into the injection air plenum. An outer sleeve is slidingly engaged with the outer air shield. The outer sleeve has a first position that restricts flow through the inlet passage and a second position that increases flow through the inlet passage.

20 Claims, 9 Drawing Sheets

SYSTEM FOR PROVIDING A WORKING FLUID TO A COMBUSTOR

FIELD OF THE INVENTION

The present invention generally involves a combustor of a gas turbine. More specifically, the invention relates to a system for providing a working fluid to a combustor.

BACKGROUND OF THE INVENTION

A typical gas turbine that is used to generate electrical power includes an axial compressor at the front, one or more combustors downstream from the compressor, and a turbine at the rear. Ambient air may be supplied to the compressor, and rotating blades and stationary vanes in the compressor progressively impart kinetic energy to the working fluid (air) to produce a compressed working fluid at a highly energized state. The compressed working fluid exits the compressor and flows towards a head end of combustor where it reverses direction at an end cover and flows through the one or more nozzles into a primary combustion zone that is defined within a combustion chamber in each combustor. The compressed working fluid mixes with fuel in the one or more fuel nozzles and/or within the combustion chamber and ignites to generate combustion gases having a high temperature and pressure. The combustion gases expand in the turbine to produce work. For example, expansion of the combustion gases in the turbine may rotate a shaft connected to a generator to produce electricity.

In a particular combustor design, one or more fuel injectors, also known as late lean fuel injectors, are circumferentially arranged around the combustion chamber downstream from the nozzles and/or the primary combustion zone. A portion of the compressed working fluid exiting the compressor is routed through the fuel injectors to mix with fuel to produce a lean fuel-air mixture. The lean fuel-air mixture may then be injected into the combustion chamber for additional combustion in a secondary combustion zone to raise the combustion gas temperature and increase the thermodynamic efficiency of the combustor. The late lean fuel injectors are effective at increasing combustion gas temperatures without producing a corresponding increase in the production of undesirable emissions such as oxides of nitrogen ($NO_x$). The late lean fuel injectors are particularly beneficial for reducing NOx during base load and/or turndown operation of the gas turbine. In contrast, during certain non-base load operation modes such as during start-up, cold fuel and liquid fuel operation late lean fuel injection is undesirable, thus the late lean fuel injectors are not fueled.

Although fuel to the late lean fuel injectors may be shut off during operation of the gas turbine, the compressed working fluid flowing to the late lean fuel injectors is routed through a passive circuit that is defined within an outer casing such as a compressor discharge casing and thus cannot be shut off. As a result, the compressed working fluid flows through the late lean fuel injectors and the liner and mixes with the combustion gases flowing through the hot gas path, thereby causing air dilution of the combustion gases which may result in undesirable emissions levels. To overcome the effects of the air dilution, an operator must over fire the one or more fuel nozzles that feed the primary combustion zone. However, over firing may result in high combustion liner and/or transition duct wall temperatures which limits the mechanical life of those hot gas path components. Therefore, a system for controlling a flow rate of the compressed working fluid to the fuel injectors would be useful.

BRIEF DESCRIPTION OF THE INVENTION

Aspects and advantages of the invention are set forth below in the following description, or may be obvious from the description, or may be learned through practice of the invention.

One embodiment of the present invention is a system for supplying a working fluid to a combustor. The system generally includes a fuel nozzle, a combustion chamber disposed downstream from the fuel nozzle, an inner flow sleeve that circumferentially surrounds the combustion chamber and a plurality of injectors circumferentially arranged around the inner flow sleeve. The plurality of injectors provide for fluid communication through the inner flow sleeve and into the combustion chamber downstream from the fuel nozzle. The system further includes an outer air shield that defines an injection air plenum that surrounds the plurality of injectors. An inlet passage extends through the outer air shield to define a flow path into the injection air plenum. An outer sleeve is slidingly engaged with the outer air shield. The outer sleeve has a first position that restricts flow through the inlet passage and a second position that increases flow through the inlet passage.

Another embodiment of the present invention is a system for supplying a working fluid to a combustor. The system includes a combustion chamber, a liner that circumferentially surrounds at least a portion of the combustion chamber, an outer air shield that surrounds at least a portion of the liner and an injection air plenum that is at least partially defined between the liner and the outer air shield. The system further includes a plurality of inlet passages that extend through the outer air shield to provide for fluid communication into the injection air plenum. An outer sleeve is disposed upstream from the plurality of inlet passages. The outer sleeve has a first position that restricts flow through the plurality of inlet passages and a second position that increases flow through the plurality of inlet passages.

The present invention may also include a gas turbine. The gas turbine generally includes a compressor, a combustor disposed downstream from the compressor and a turbine disposed downstream from the combustor. The combustor comprises a fuel nozzle, a combustion chamber disposed downstream from the fuel nozzle, an inner flow sleeve that circumferentially surrounds the combustion chamber and a plurality of injectors arranged circumferentially around the inner flow sleeve. The plurality of injectors provide for fluid communication through the inner flow sleeve and into the combustion chamber. An outer air shield defines an injection air plenum around the plurality of injectors. A plurality of inlet passages extends through the outer air shield to define a plurality of flow paths into the injection air plenum. An outer sleeve is slidingly engaged with the outer air shield. The outer sleeve has a first position that restricts flow through at least some of the inlet passages and a second position that increases flow through at least some of the inlet passages.

Those of ordinary skill in the art will better appreciate the features and aspects of such embodiments, and others, upon review of the specification.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

DETAILED DESCRIPTION OF THE INVENTION

Figure 1:
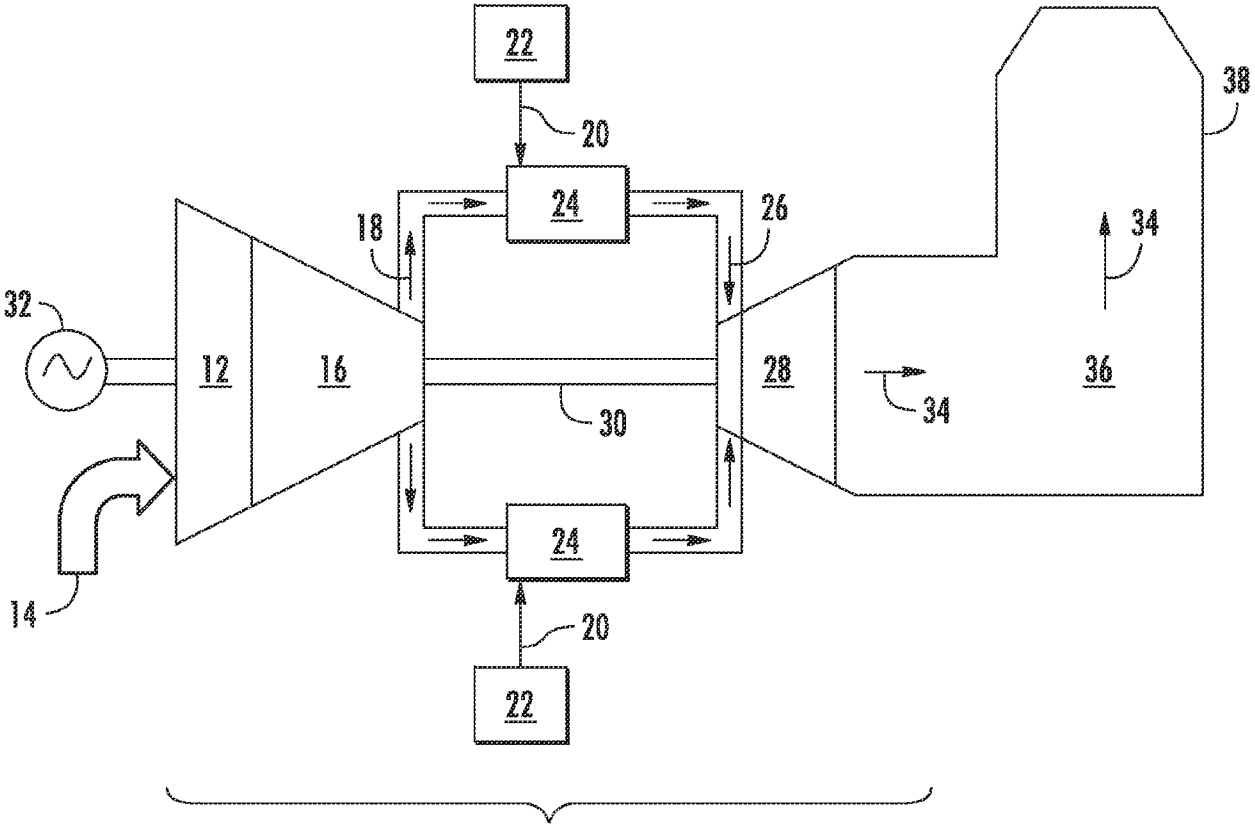
FIG. 1 PRIOR ART
FIG. 1 is a functional block diagram of an exemplary gas turbine within the scope of the present invention.

Reference will now be made in detail to present embodiments of the invention, one or more examples of which are illustrated in the accompanying drawings. The detailed description uses numerical and letter designations to refer to features in the drawings. Like or similar designations in the drawings and description have been used to refer to like or similar parts of the invention. As used herein, the terms "first", "second", and "third" may be used interchangeably to distinguish one component from another and are not intended to signify location or importance of the individual components. The terms "upstream" and "downstream" refer to the relative direction with respect to fluid flow in a fluid pathway. For example, "upstream" refers to the direction from which the fluid flows, and "downstream" refers to the direction to which the fluid flows. The term "radially" refers to the relative direction that is substantially perpendicular to an axial centerline of a particular component, and the term "axially" refers to the relative direction that is substantially parallel to an axial centerline of a particular component. The term "circumferentially" refers to a relative direction that extends around an axial centerline of a particular component.

Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents. Although exemplary embodiments of the present invention will be described generally in the context of a combustor incorporated into a gas turbine for purposes of illustration, one of ordinary skill in the art will readily appreciate that embodiments of the present invention may be applied to any combustor incorporated into any turbomachine and is not limited to a gas turbine combustor unless specifically recited in the claims.

Various embodiments of the present invention include a system for supplying a working fluid to a combustor. In general, the system includes multiple late-lean injectors that circumferentially surround a combustion chamber. The system diverts or routes a portion of the working fluid through the late-lean injectors and into the combustion chamber. An outer sleeve upstream from the late-lean injectors controls the amount of working fluid diverted through one or more of the late-lean injectors. In particular embodiments, an outer air shield defines an injection air plenum that surrounds the one or more late-lean injectors. A plurality of inlet passages provide for fluid communication into the injection air plenum. The outer sleeve slides axially and/or circumferentially across the outer air shield so as to at least partially open or close one or more of the inlet passages, thereby restricting or increasing flow of the working fluid to the late-lean injectors. As a result, the system disclosed herein enables the amount of working fluid diverted through the late-lean injectors to be varied or stopped as desired to control flame holding conditions in the combustion chamber and/or to prevent or reduce dilution of combustion gases flowing through the combustor. As a result, over firing of combustor may be prevented thereby increasing the performance and enhancing the mechanical life of the combustor. Although exemplary embodiments of the present invention will be described generally in the context of a combustor incorporated into a gas turbine for purposes of illustration, one of ordinary skill in the art will readily appreciate that embodiments of the present invention may be applied to any combustor and are not limited to a gas turbine combustor unless specifically recited in the claims.

Referring now to the drawings, wherein identical numerals indicate the same elements throughout the figures, FIG. 1 provides a functional block diagram of an exemplary gas turbine 10 that may incorporate various embodiments of the present invention. As shown, the gas turbine 10 generally includes an inlet section 12 that may include a series of filters, cooling coils, moisture separators, and/or other devices to purify and otherwise condition a working fluid (e.g., air) 14 entering the gas turbine 10. The working fluid 14 flows to a compressor section where a compressor 16 progressively imparts kinetic energy to the working fluid 14 to produce a compressed working fluid 18 at a highly energized state.

The compressed working fluid 18 is mixed with a fuel 20 from a fuel supply 22 to form a combustible mixture within one or more combustors 24. The combustible mixture is burned to produce combustion gases 26 having a high temperature and pressure. The combustion gases 26 flow through a turbine 28 of a turbine section to produce work. For example, the turbine 28 may be connected to a shaft 30 so that rotation of the turbine 28 drives the compressor 16 to produce the compressed working fluid 18. Alternately or in addition, the shaft 30 may connect the turbine 28 to a generator 32 for producing electricity. Exhaust gases 34 from the turbine 28 flow through an exhaust section 36 that connects the turbine 28 to an exhaust stack 38 that is downstream from the turbine 28. The exhaust section 36 may include, for example, a heat recovery steam generator (not shown) for cleaning and extracting additional heat from the exhaust gases 34 prior to release to the environment.

Figure 2:
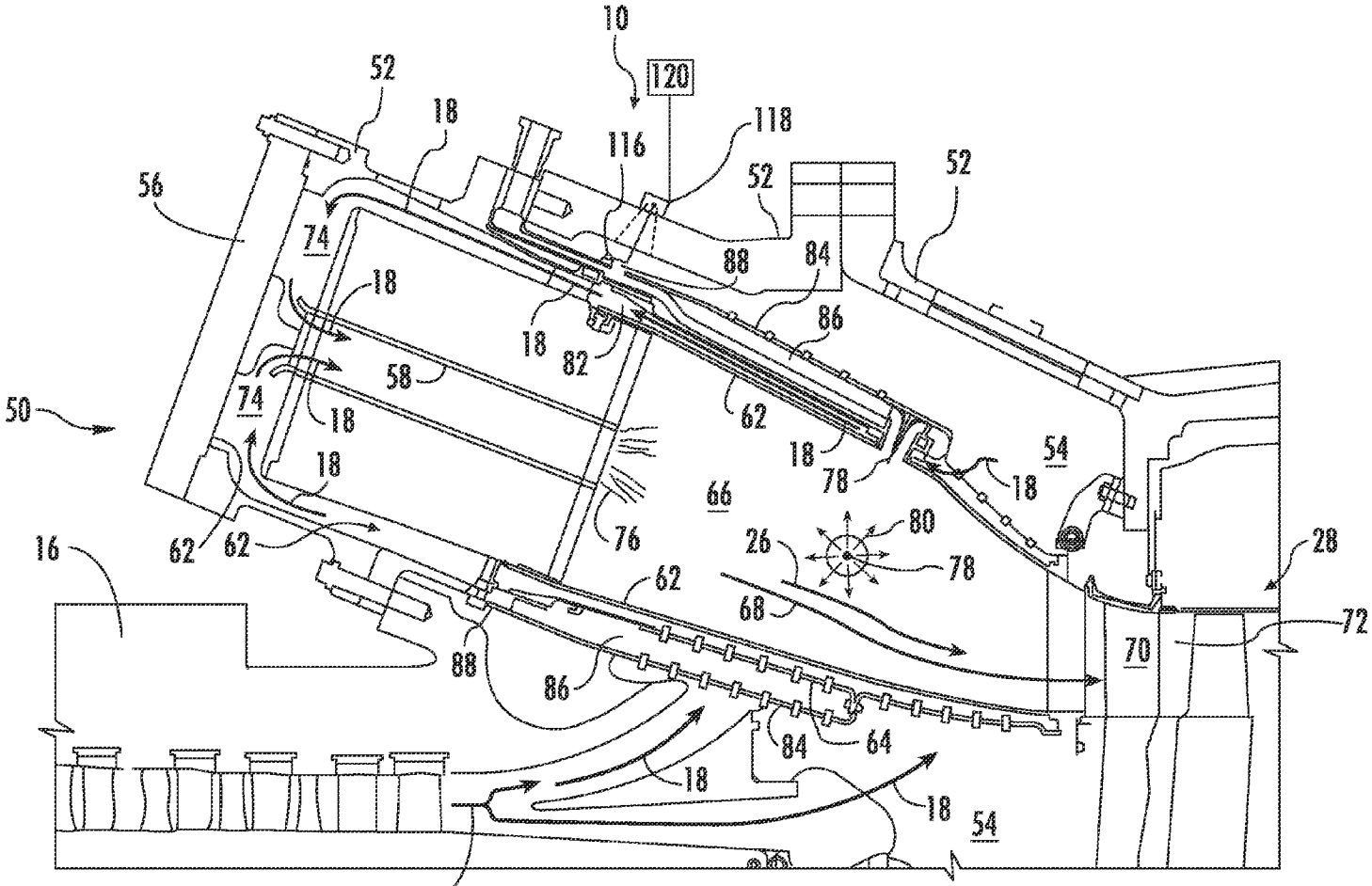
FIG. 2 is a cross-section side view of a portion of an exemplary gas turbine according to at least one embodiment of the present invention.

FIG. 2 provides a cross sectional side view of a portion of an exemplary gas turbine 10 including an exemplary combustor 50 that may encompass various embodiments of the present disclosure. As shown, the combustor 50 is at least partially surrounded by an outer casing 52 such as a compressor discharge casing and/or an outer turbine casing. The outer casing 52 is in fluid communication with the compressor 16 and at least partially defines a high pressure plenum 54 that surrounds at least a portion of the combustor 50. An end cover 56 is coupled to the outer casing 52 at one end of the combustor 50.

As shown in FIG. 2, the combustor 50 generally includes at least one fuel nozzle 58 that extends generally axially downstream from the end cover 56. An annular cap assembly 60 extends radially and axially within the outer casing 52 downstream from the end cover 56. An annular duct or liner 62 extends downstream from the cap assembly 60. An inner flow sleeve 64 surrounds at least a portion of the liner 62. The combustor 50 includes a combustion chamber 66 disposed downstream from the fuel nozzle 58. In particular embodiments, the liner at least partially surrounds the combustion chamber 66.

The liner 62 generally defines a hot gas path 68 for routing the combustion gases 26 from the combustion chamber 66 through the combustor 50 towards a first stage of stationary nozzles 70 which at least partially define an inlet 72 to the turbine 28. The end cover 56 and the cap assembly 60 at least partially define a head end 74 of the combustor 50. The fuel nozzle 58 may extend at least partially through the cap assembly 60 to provide a first combustible mixture 76, consisting primarily of the fuel 20 (FIG. 1) from the fuel supply 22 (FIG. 1) and a portion of the compressed working fluid 18 from the compressor 16, to the combustion chamber 66 downstream from the fuel nozzle 58.

In particular embodiments, the combustor 50 includes at least one injector 78, also known as a late-lean injector that extends through the inner flow sleeve 64 and/or the combustion liner 62 at a point that is downstream from the fuel nozzle 58. In one embodiment, the combustor 50 includes a plurality of injectors 78 circumferentially arranged around the inner flow sleeve 64. The injectors 78 extend through the inner flow sleeve 64 and/or the combustion liner 62 at a point that is downstream from the fuel nozzle(s) 58. The injectors 78 may extend generally radially inwards with respect to an axial centerline of the liner 32. The injectors 78 provide for fluid communication through the inner flow sleeve 64 and/or the liner 62 into the combustion chamber 66. In operation, the injectors 78 provide for injection of a lean fuel-air combustible mixture, or a combustible mixture having a fuel-air equivalence ratio of less than 1, into the combustion chamber 66. During certain operational modes of the gas turbine 10 such as startup, base-load or turn down operation of the gas turbine the fuel supply to the injector(s) 78 may be may be shut off, thereby allowing for direct injection of the compressed working fluid 18 into the combustion chamber 66.

Figure 3:
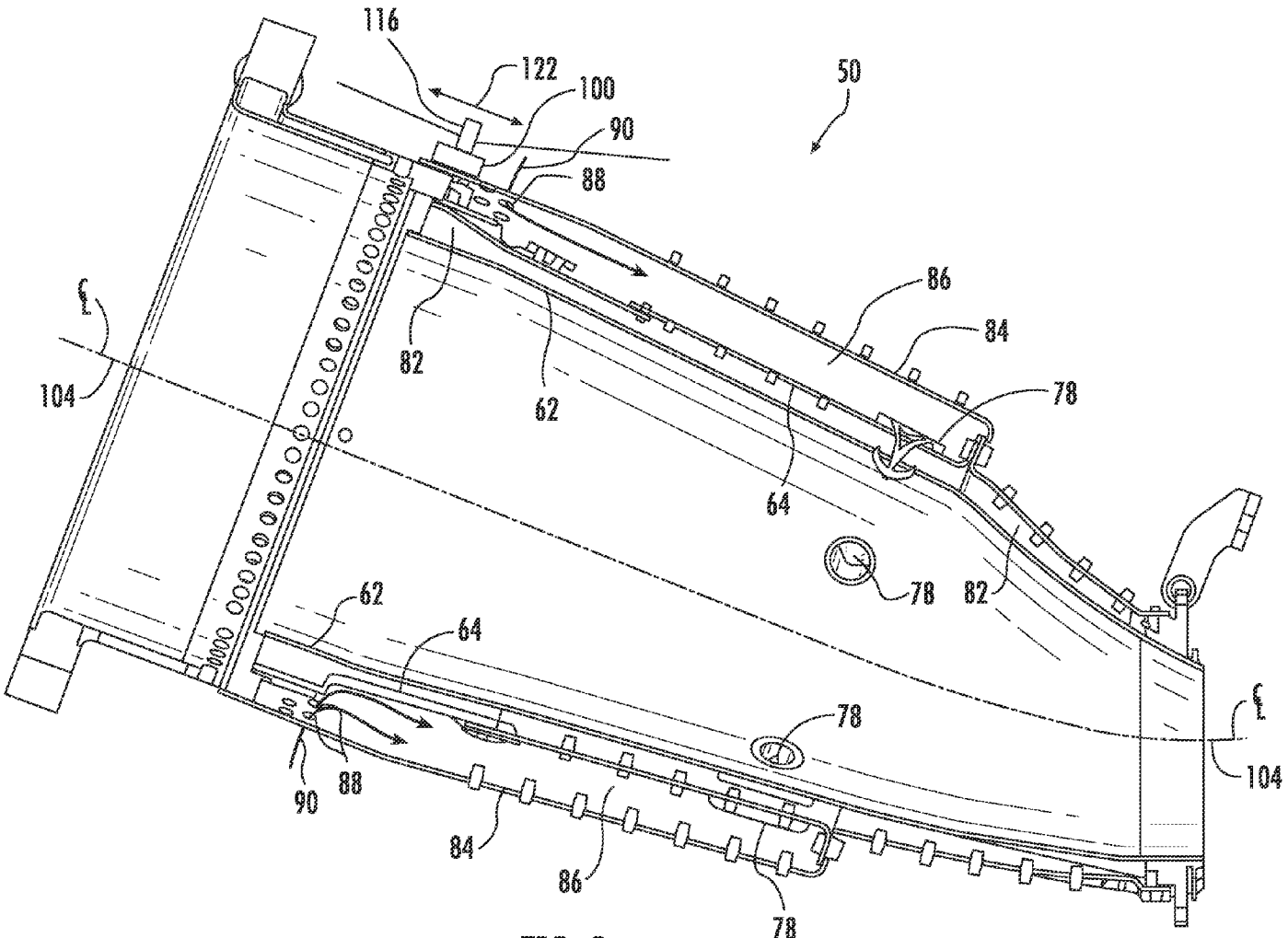
FIG. 3 is a cross section side view of a portion of the combustor 50 as shown in FIG. 2, according to one embodiment of the present invention.
Figure 4:
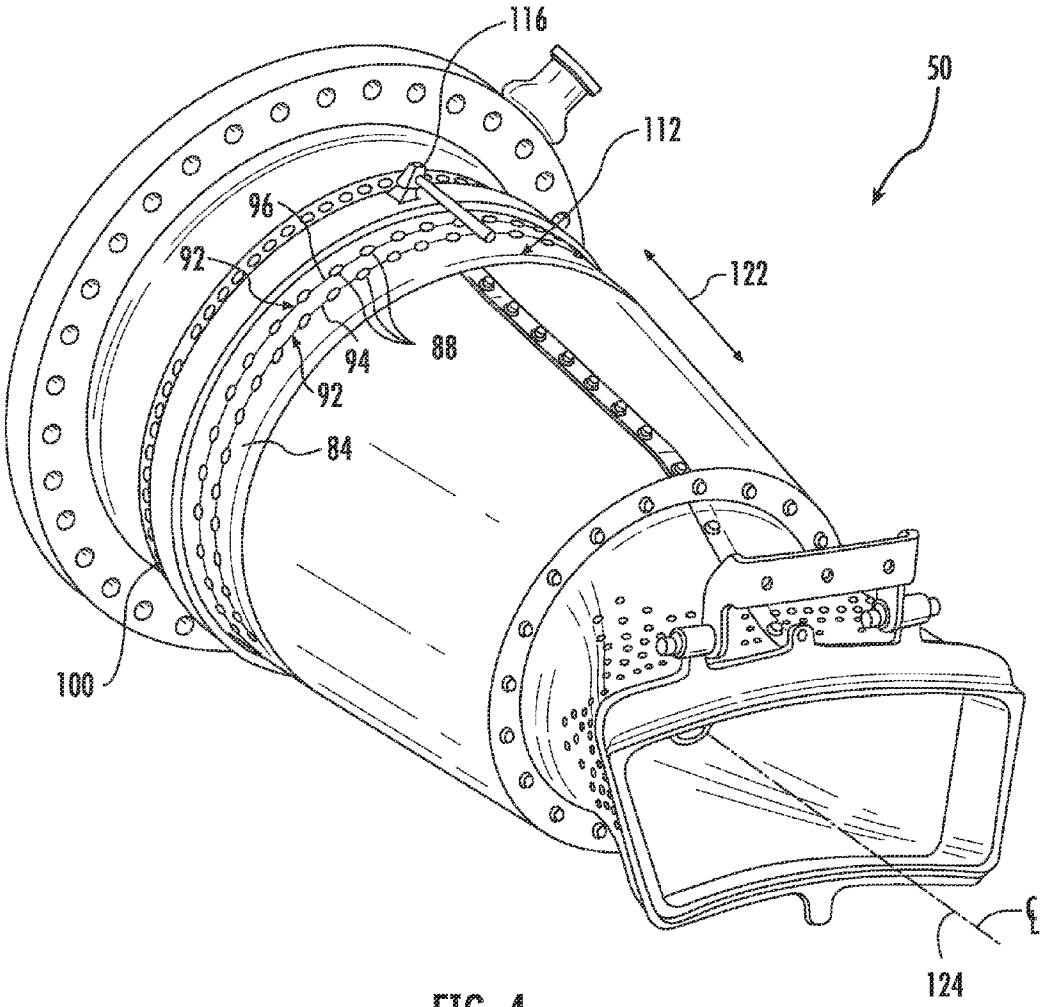
FIG. 4 is a perspective view of the portion of the combustor as shown in FIG. 3, according to one embodiment of the present invention.

FIG. 3 provides a cross section side view of a portion of the combustor 50 as shown in FIG. 2 removed from the outer casing 52 for clarity, including the liner 62, the inner flow sleeve 64 and the injector(s) 78, according to at least one embodiment of the present disclosure. FIG. 4 provides a perspective view of the portion of the combustor 50 as shown in FIG. 3, according to one embodiment of the present disclosure. As shown in FIG. 3, a cooling flow passage 82 may be at least partially defined between the liner 62 and the inner flow sleeve 64. As shown in FIG. 2, the cooling flow passage 82 may be in fluid communication with the head end 74 (FIG. 2) of the combustor 50.

In particular embodiments, as shown in FIG. 3, the combustor 50 includes an outer air shield 84 that surrounds at least a portion of the inner flow sleeve 64 and/or the liner 62. The outer air shield 84 is radially separated from the inner flow sleeve 64 so as to define an injection air plenum 86 between the outer air shield 84 and the inner flow sleeve 64. In particular embodiments, the outer air shield 84 at least partially surrounds the fuel injectors 78. The fuel injectors 78 are in fluid communication with the injection air plenum 86 to allow for flow between the air injection plenum 86 and the combustion chamber 66.

In particular embodiments, as shown in FIG. 3, at least one inlet passage 88 extends through the outer air shield 84 to define a flow path 90 into the injection air plenum 86. The inlet passage 88 generally provides for fluid communication between the high pressure plenum 54 (FIG. 2) and the injection air plenum 86 (FIGS. 2 and 3). In this manner, the compressed working fluid 18 flows from the high pressure plenum, through the inlet passage 88 along the flow path 90 into the air injection plenum 86. The compressed working fluid then flows through the injectors 78 and into the combustion chamber. In one embodiment, as shown in FIGS. 3 and 4, a plurality of inlet passages 88 extends through the outer air shield 84 so as to define a plurality of flow paths 90 (FIG. 3).

As shown in FIG. 4, the inlet passages 88 may be arranged in one or more rows 92 that extend circumferentially around at least a portion of the outer air shield 84. For example, the inlet passages 88 may be arranged in a first row 94 that is axially separated from a second row 96. The first row 94 and the second row 96 may be arranged so as to axially align the inlet passages 88 of the first and second rows 92, 94. In the alternative, the first row 94 and the second row 96 may be arranged so as to clock or offset the inlet passages 88 of the first and second rows 92, 94.

In various embodiments, as shown in FIG. 4, the combustor 50 includes an outer sleeve or flow regulation sleeve 100. The outer sleeve 100 extends circumferentially around at least a portion of the outer air shield 84 generally proximate to the inlet passages 88. In one embodiment, the outer sleeve 100 is positioned upstream from the inlet passages 88 with respect to a direction of flow of the compressed working fluid 18 flowing from the high pressure plenum 54 (FIG. 2) into the inlet passages 88. In other words, the outer sleeve 100 may be positioned over or on top of the inlets passages 88. In particular embodiments, the outer sleeve 100 is slidingly engaged with the outer air shield 84 to provide for relative movement between the outer air shield 84 and the outer sleeve 100 during operation of the combustor 50.

Figure 6:
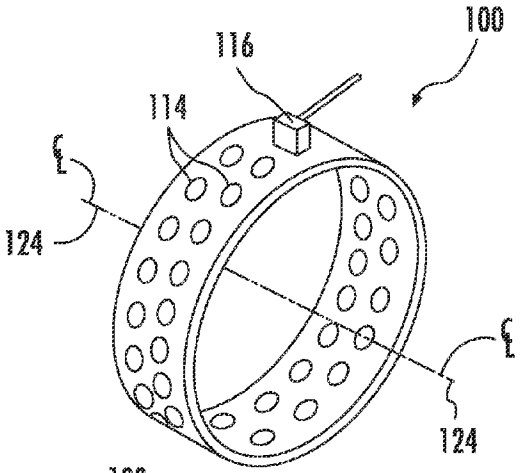
FIG. 6 is a perspective view of an exemplary outer sleeve as shown in FIG. 5, according to one embodiment of the present invention.
Figure 5:
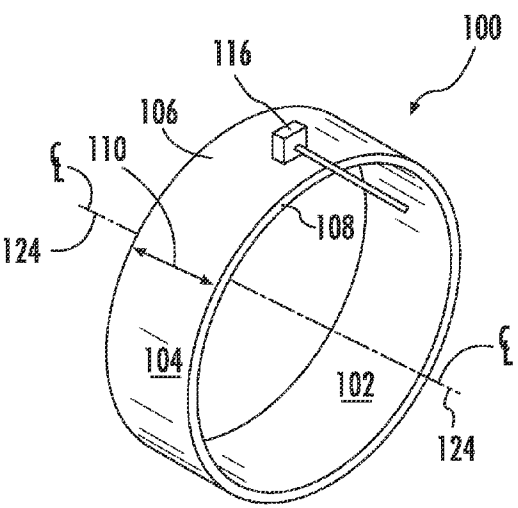
FIG. 5 is a perspective view of an exemplary outer sleeve as shown according to one embodiment of the present invention.
Figure 7:
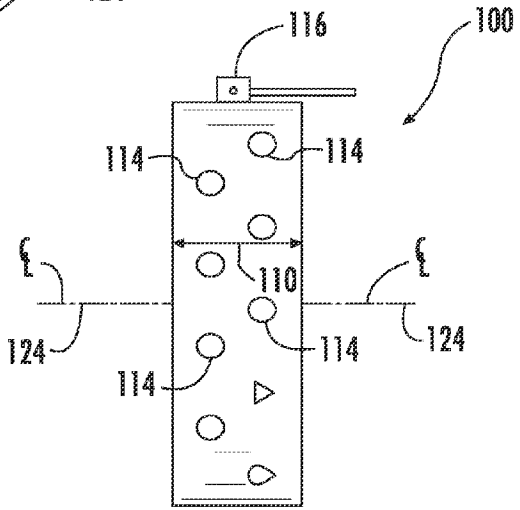
FIG. 7 is a side view of the exemplary outer sleeve as shown in FIG. 6, according to various embodiments of the present invention.
Figure 9:
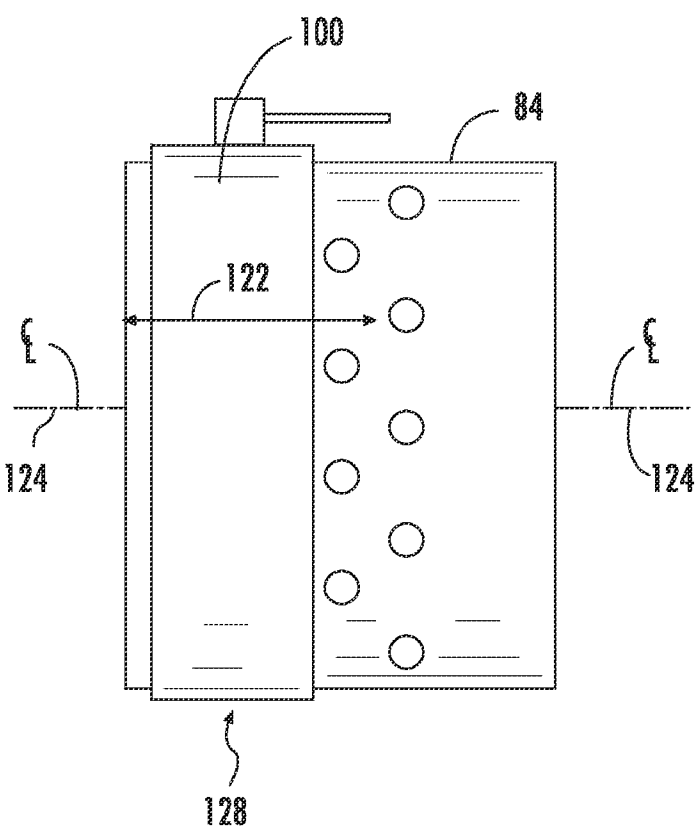
FIG. 9 is a side view of a portion of an outer air shield and the outer sleeve as shown in FIG. 5, according to one embodiment of the present invention.
Figure 8:
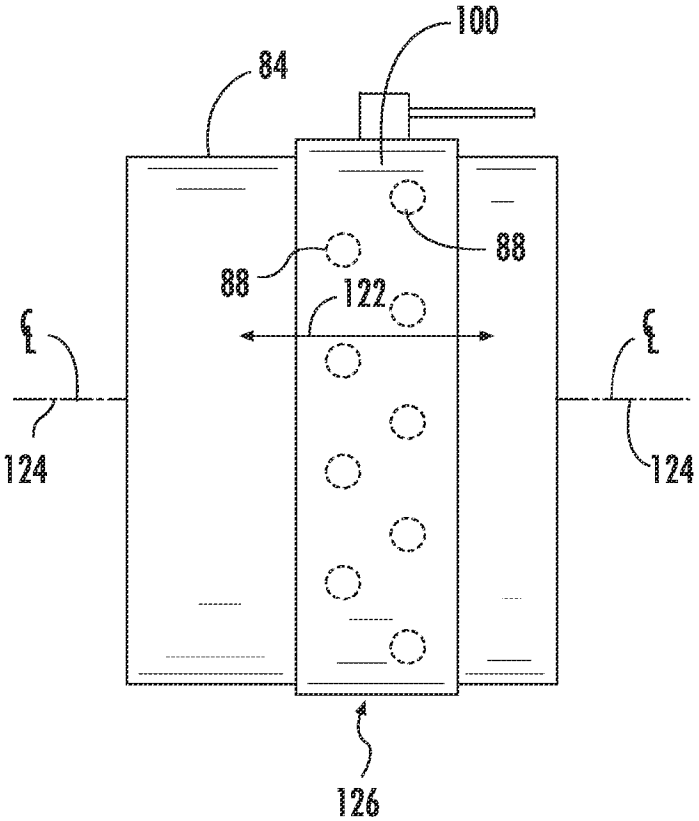
FIG. 8 is a side view of a portion of an outer air shield and the outer sleeve as shown in FIG. 5, according to one embodiment of the present invention.

FIGS. 5 and 6 provide a perspective view of an exemplary outer sleeve 100 as shown in FIG. 4, according to at least one embodiment of the present invention. FIG. 7 provides a side view of the exemplary outer sleeve 100 as shown in FIG. 6, according to an alternate embodiment of the present invention. As shown in FIG. 5, the outer sleeve 100 may have a generally annular shape. Although the outer sleeve 100 is shown as being circular, it should be obvious to one of ordinary skill in the art that the outer sleeve 100 may be less than circular. For example, the outer sleeve 100 may be semicircular in shape.

The outer sleeve 100 generally includes an inner surface 102, an outer surface 104, a forward 106 end and an aft end 108. The outer sleeve also has an axial length 110 that extends between the forward and aft ends 106, 108. The inner surface 102 of the outer sleeve 100 may be slidingly engaged with an outer surface 112 (FIG. 4) of the outer air shield 84 (FIG. 4). In particular embodiments, as shown in FIG. 6, the outer sleeve 100 may include at least one opening 114 that extends through the outer sleeve 100. In particular embodiments, the outer sleeve comprises a plurality of openings 114. The openings may be arranged to at least partially align with one or more of the inlet passages 88. In this manner, at least some of the openings 114 may be at least partially aligned with at least some of the inlet passages 88 to allow for flow of the compressed working fluid 18 through the openings 114, through the inlets passages 88 along the flow paths 90 and into the injection air plenum 86. As shown in FIG. 6, the openings 114 may be circular shaped. In addition or in the alternative, as shown in FIG. 7, each or some of the one or more openings 114 may be non-circular. For example, each or some of the openings 114 may have a tear-drop shape or an oval shape. In addition, the openings 114 may be oriented axially and/or circumferentially around the outer sleeve 100.

As shown in FIGS. 5, 6 and 7 the outer sleeve 100 may be coupled to a linkage mechanism 116 such as a pivoting arm. As shown in FIG. 2, the linkage mechanism 116 may be coupled to an actuating mechanism 118 such as a linear actuator to cause the outer sleeve 100 to translate axially across and/or circumferentially around the outer air shield 84. In particular embodiments, an electronic controller 120 may be electronically coupled to the actuating mechanism 118. The controller 120 may be any controller that is suitable for causing the actuating mechanism 118 to actuate the linkage mechanism 116, thereby causing the outer shield 100 to slide or translate through various axial and/or circumferential positions across or around the outer shield 100. As a result, the controller 120 may cause the outer shield 100 to at least partially open and/or close the inlet passages 88 (FIG. 4) in response to a user input or in response to a feedback signal from a sensor (not shown) disposed on and/or within the gas turbine 10. The controller 120 may be and/or may include a computer system having a processor(s) that executes programs to control the position of the outer sleeve 100.

In one embodiment, as shown in FIG. 4, the outer sleeve 100 slides or translates in an axial direction 122 across the outer air shield 84 with respect to an axial centerline 124 of the combustor 50. The outer sleeve 100 generally slides or translates axially across the inlet passages 88 through various axial positions so as to at least partially open or at least partially close the inlet passages 88, thereby increasing or restricting a flow rate of the compressed working fluid 18 flowing through the inlet passages 88 along the flow paths 90 and into the injection air plenum 86.

FIGS. 8, 9, 10, and 11 each provide a side view of a portion of the outer air shield 84 and the outer sleeve 100 with the outer sleeve 100 at various axial positions according to various embodiments of the present invention. The outer sleeve 100 may be positioned at any point between a first position 126 (FIG. 8) wherein flow of the compressed working fluid 18 (FIG. 2) through the inlet passages 88 along the flow paths 90 (FIG. 3) is fully restricted, and a second position 128 (FIG. 9) where flow of the compressed working fluid 18 (FIG. 2) through the inlet passages 88 along the flow paths 90 (FIG. 3) is fully open or unrestricted by the outer sleeve 100, thereby increasing the flow through the inlet passages 88 along the flow paths 90 and into the injection air plenum 86 with respect to the outer sleeve being in the first position 126.

Figure 11:
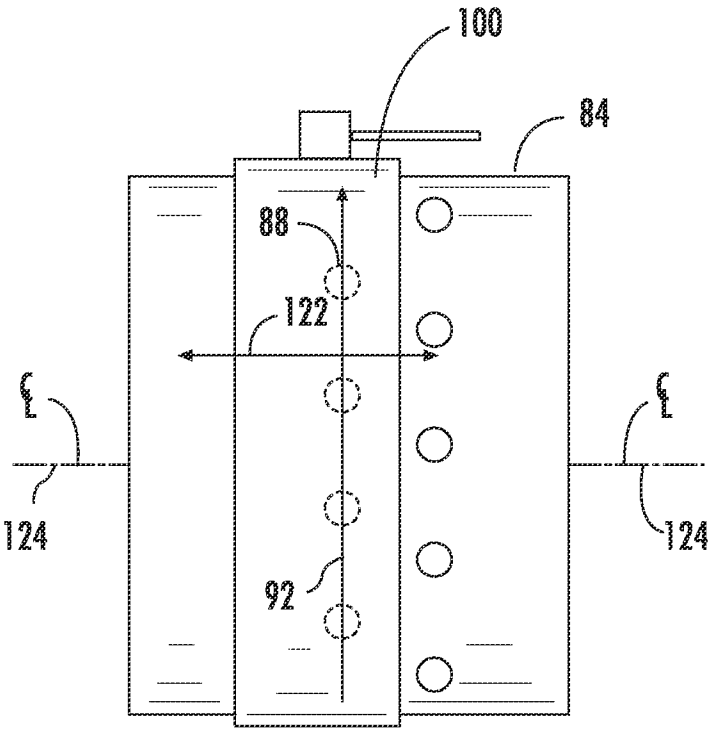
FIG. 11 is a side view of a portion of an outer air shield and the outer sleeve as shown in FIG. 5, according to one embodiment of the present invention.
Figure 10:
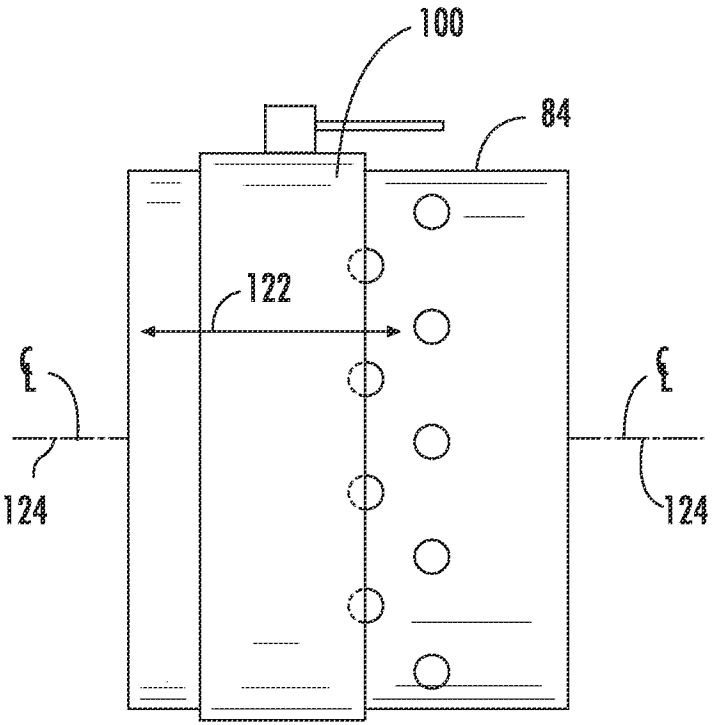
FIG. 10 is a side view of a portion of an outer air shield and the outer sleeve as shown in FIG. 5, according to one embodiment of the present invention.

In various embodiments, as shown in FIG. 10, the outer sleeve 100 may be positioned to partially cover at least some of the inlet passages 88. As shown in FIG. 11, the outer sleeve 100 may be positioned to cover the first row 94 of the inlet passages 88 while leaving the second row 96 of the inlet passages 88 fully open or unrestricted. The embodiments shown in FIGS. 10 and 11 generally provide for fine tuning of the flow of the compressed working fluid 18 (FIG. 2) into the injection air plenum 86 during operation of the injectors 78, thereby providing for active control of the late-lean fuel injection process, thus resulting in improved overall performance of the combustor 50.

Figure 12:
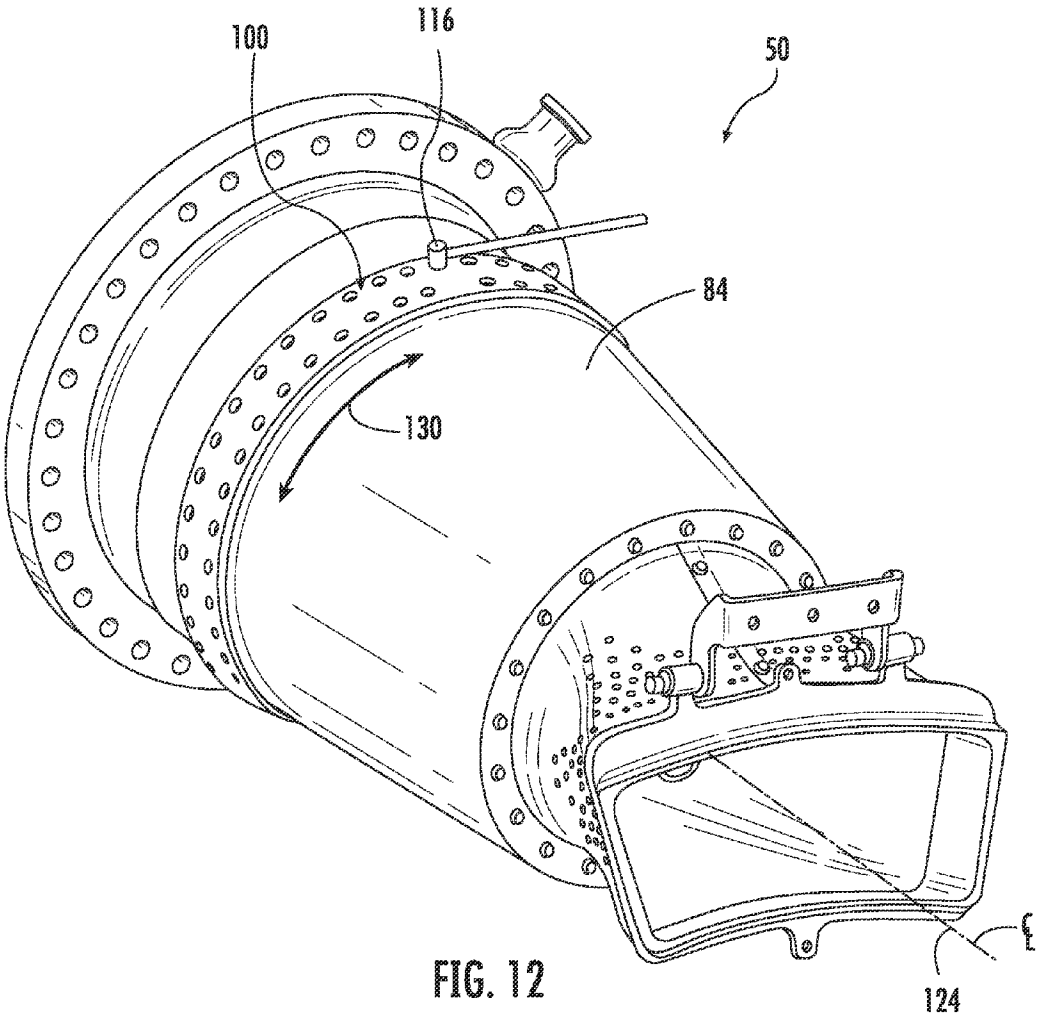
FIG. 12 is a perspective view of the portion of the combustor as shown in FIG. 3, according to one embodiment of the present invention.
Figures 13, 14, 15:
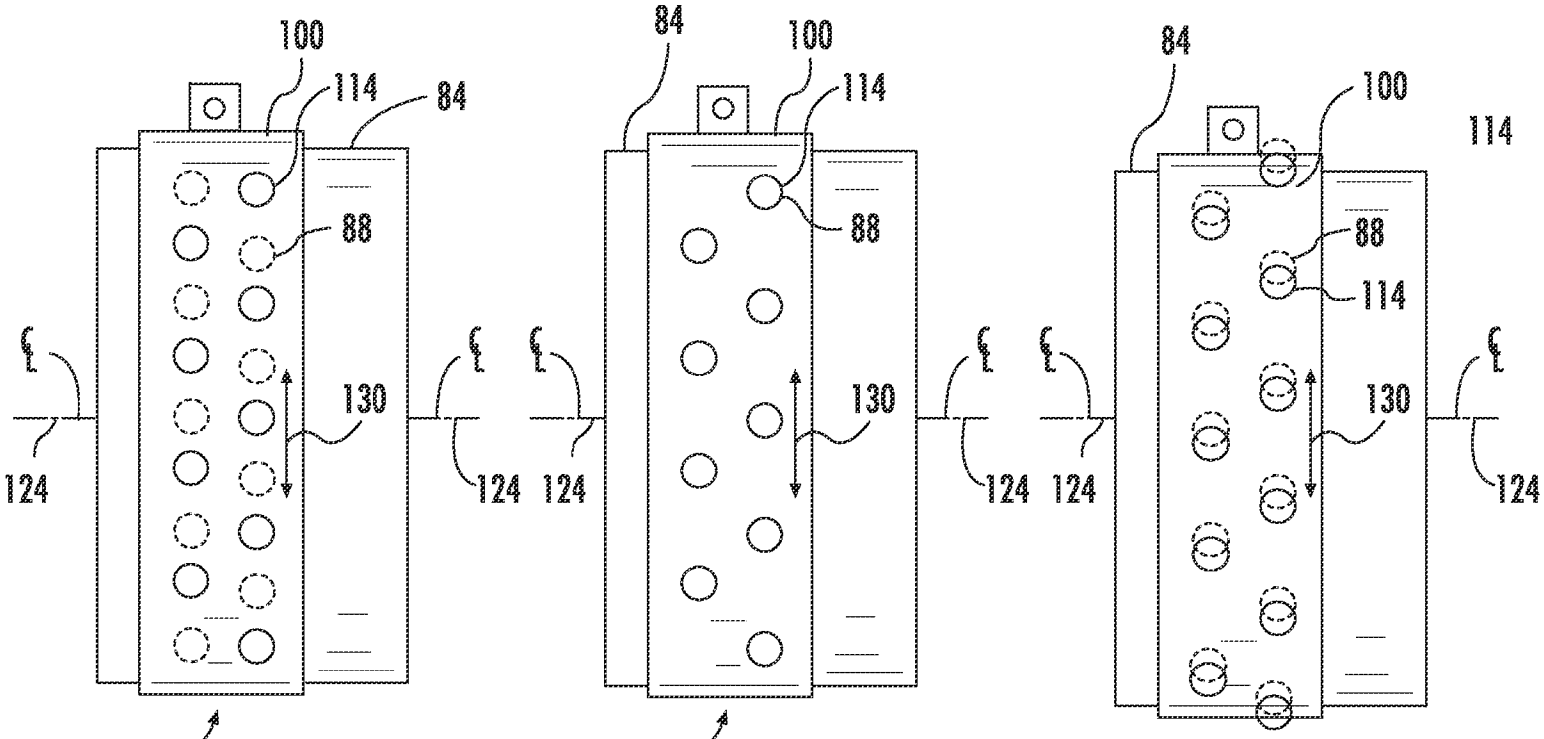
FIG. 13 is a side view of a portion of an outer air shield and the outer sleeve as shown in FIG. 6, according to one embodiment of the present invention.
FIG. 14 is a side view of a portion of an outer air shield and the outer sleeve as shown in FIG. 6, according to one embodiment of the present invention.
FIG. 15 is a side view of a portion of an outer air shield and the outer sleeve as shown in FIG. 6, according to one embodiment of the present invention.

FIG. 12 provides a perspective view of a portion of the combustor 50 as shown in FIG. 3 including the outer sleeve 100 according to at least one embodiment of the present invention, and FIGS. 13, 14 and 15 each provide a side view of a portion of the outer air shield 84 and the outer sleeve 100 with the outer sleeve 100 at various circumferential positions according to various embodiments of the present invention. In one alternate embodiment, as shown in FIG. 12, the outer sleeve 92 slides or translates circumferentially or in a circumferential direction 130 around the outer air shield 84 with respect to the axial centerline of the combustor 50. The outer sleeve 100 generally slides or translates circumferentially across the inlet passages 88 through various positions so as to at least partially open or at least partially close the inlet passages 88, thereby restricting or increasing flow of the compressed working fluid 18 (FIG. 2) flowing into the injection air plenum 86 along the flow paths 90 defined by the inlet passages 88.

In particular embodiments, as shown in FIGS. 12, 13, 14 and 15 the outer sleeve 100 includes the openings 114. The openings 114 are generally arranged to at least partially align with the inlet passages 88 as the outer sleeve 100 slides or translates through the various circumferential positions. The outer sleeve 100 may be positioned at any point between a first position 132 (FIG. 13) wherein flow of the compressed working fluid 18 (FIG. 2) through the inlet passages 88 along the flow paths 90 (FIG. 3) is fully restricted, and a second position 134 (FIG. 14) where flow of the compressed working fluid 18 (FIG. 2) through the inlet passages 88 along the flow paths 90 (FIG. 3) is fully open or unrestricted by the outer sleeve 100, thereby increasing the flow through the inlet passages 88 along the flow paths 90 and into the injection air plenum 86 with respect to the outer sleeve being in the first position 132.

In various embodiments, as shown in FIG. 15, the outer sleeve 100 may be positioned so that the flow sleeve 100 partially covers at least some of the inlet passages 88. This provides for fine tuning of the flow of the compressed working fluid 18 (FIG. 2) into the injection air plenum 86 (FIG. 3) during operation of the injectors 78, thereby providing for active control of the fuel-air mixture or fuel-air equivalence ratio of the second combustible mixture 80 flowing into the combustion chamber 66, thus resulting in improved overall performance of the combustor 50.

In operation, as presented in FIGS. 2 through 15, the compressed working fluid 18 flows from the compressor 16 and is routed into the high pressure plenum 54. A first portion of the compressed working fluid 18 is routed through the cooling flow passage 82 towards the end cover 56 where it reverses direction and is then directed through the axially extending fuel nozzle 58. The first portion of the compressed working fluid 18 is mixed with fuel 22 (FIG. 1) to from the first combustible mixture 76 that is injected into the combustion chamber 66 for combustion.

During certain operation modes of the gas turbine 10 such as during base-load or turn down operation, the outer sleeve 100 is actuated to slide or translate axially and/or circumferentially to allow a second portion of the compressed working fluid 18 to flow from the high pressure plenum 54 through at least some of the inlet passages 88 along the flow paths 90 and into the injection air plenum 86. The outer sleeve 100 may be actuated axially and/or circumferentially to restrict or increase the flow of the second portion of the compressed working fluid 18 flowing through the inlet passages 88 into the injection air plenum 86 as required. The second portion of the compressed working fluid 18 is then routed through the injectors 78 where it is mixed with fuel and flows through the inner flow sleeve 64 and/or the liner 62 to provide the second combustible mixture 76 to the combustion chamber 66.

During certain operation modes of the gas turbine 10 such as during cold fuel operation, liquid fuel operation and/or start-up operation the outer sleeve 100 may be actuated so that is slides or translates across and/or around the outer air shield 84 to at least partially or fully restrict the flow of the second portion of the compressed working fluid 18 through inlet passages 88, thereby reducing or preventing air dilution to the combustion gases 26 flowing through the hot gas path 68 from the combustion chamber 66. The outer sleeve 100 provides a flow barrier between the high pressure plenum 54 and the injection air plenum 86. As a result, the first and the second portions of the compressed working fluid 18 may be routed through the cooling flow passage 82 towards the head end 74 of the combustor 50, thereby reducing the potential for flame holding at the fuel nozzle 58. In addition, by shutting off the flow of the second portion of the compressed working fluid 18 to the injection air plenum 86, dilution of the combustion gases 26 flowing through the hot gas path 68 may be reduced or eliminated, thereby enhancing emissions performance and/or mechanical performance of the combustor 50.

The various embodiments of the present invention may provide one or more technical advantages over existing late-lean injection systems. For example, the systems described herein may be used to adjust the amount of the compressed working fluid 18 diverted through the injectors 60 during liquid fuel operations and/or to reduce the flame holding conditions proximate to the fuel nozzle 58. In addition, the embodiments described herein may be used to fine tune the compressed working fluid 18 flow through the inlet passages 88 and to the injectors 78 to reduce variations in the pressure and/or flow of the working fluid 18 through each injector 60. Other advantages include enhanced mechanical life of the liner 62 that results from over firing of the combustor 50 and lower emissions for cold fuel to base and liquid fuel operation while maintaining emissions benefits of late-lean injection during turndown and base-load operation of the gas turbine 10.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

What is claimed is:

1. A system for supplying a working fluid to a combustor, comprising:

a. a fuel nozzle;

b. a liner defining a combustion chamber downstream from the fuel nozzle;

c. an inner flow sleeve that circumferentially surrounds the liner, wherein the inner flow sleeve is radially spaced from the liner and forms a cooling flow passage therebetween;

d. a plurality of injectors circumferentially arranged around the inner flow sleeve, wherein the plurality of injectors provide fluid communication through the inner flow sleeve and into the combustion chamber downstream from the fuel nozzle;

e. an outer air shield that at least partially defines an injection air plenum that surrounds the plurality of injectors;

f. an inlet passage that extends through the outer air shield to define a flow path into the injection air plenum; and g. an outer sleeve slideably engaged with the outer air shield, wherein the outer sleeve has a first position that restricts flow through the inlet passage and a second position that increases flow through the inlet passage.

2. The system as in claim 1, wherein the outer sleeve slides axially across the outer air shield with respect to an axial centerline of the combustor.

3. The system as in claim 1, Wherein the outer sleeve slides circumferentially around the outer air shield with respect to an axial centerline of the combustor.

4. The system as in claim 1, wherein the first position of the outer sleeve corresponds to a fully closed inlet passage.

5. The system as in claim 1, wherein the second position of the outer sleeve corresponds to a fully open inlet passage.

6. The system as in claim 1, further comprising an opening that extends through the outer sleeve, the opening being arranged to at least partially align with the inlet passage as the outer sleeve slides between the first position and the second position.

7. The system as in claim 6, wherein the opening has a non-circular shape.

8. A system for supplying a working fluid to a combustor, comprising:

a. a combustion chamber;

b. a liner that circumferentially surrounds at least a portion of the combustion chamber;

c. an inner flow sleeve that surrounds the liner;

d. an outer air shield that surrounds at least a portion of the inner flow sleeve;

e. an injection air plenum at least partially defined between the inner flow sleeve and the outer air shield;

f. a plurality of inlet passages that extend through the outer air shield to provide fluid communication into the injection air plenum; and g. an outer sleeve upstream from the plurality of inlet passages, wherein the outer sleeve has a first position that restricts flow through the plurality of inlet passages and a second position that increases flow through the plurality of inlet passages.

9. The system as in claim 8, wherein the outer sleeve slides axially across the outer air shield with respect to an axial centerline of the combustor.

10. The system as in claim 8, wherein the outer sleeve slides circumferentially around the outer air shield with respect to an axial centerline of the combustor.

11. The system as in claim 8, wherein the first position of the outer sleeve corresponds to at least a portion of the plurality of inlet passages being fully closed.

12. The system as in claim 8, wherein the second position of the outer sleeve corresponds to at least a portion of the plurality of inlet passages being fully open.

13. The system as in claim 8, further comprising a plurality of holes that extend through the outer sleeve, the holes being arranged to at least partially align with the plurality of inlet passages as the outer sleeve slides between the first position and the second position.

14. The system as in claim 13, wherein at least some of the plurality of holes has a non-circular shape.

15. A gas turbine, comprising:

a. a compressor, a combustor disposed downstream from the compressor and a turbine disposed downstream from the combustor, the combustor comprising:

i. a fuel nozzle;

ii. a liner defining a combustion chamber downstream from the fuel nozzle;

iii. an inner flow sleeve that circumferentially surrounds the liner, wherein the inner flow sleeve is radially spaced from the liner and forms a cooling flow passage therebetween;

iv. a plurality of injectors circumferentially arranged around the inner flow sleeve, wherein the plurality of injectors provide fluid communication through the inner flow sleeve and into the combustion chamber;

v. an outer air shield that at least partially surrounds the inner flow sleeve;

vi. an injection air plenum defined between the inner flow sleeve and the outer air shield, wherein the plurality of injectors are in fluid communication with the injection air plenum;

vii. a plurality of inlet passages that extends through the outer air shield to define a plurality of flow paths into the injection air plenum; and viii. an outer sleeve slideably engaged with the outer air shield, wherein the outer sleeve has a first position that restricts flow through at least some of the inlet passages and a second position that increases flow through at least some of the inlet passages.

16. The gas turbine as in claim 15, wherein the outer sleeve slides axially across the outer air shield with respect to an axial centerline of the combustor.

17. The gas turbine as in claim 15, wherein the outer sleeve slides circumferentially around the outer air shield with respect to an axial centerline of the combustor.

18. The gas turbine as in claim 15, further comprising a plurality of holes that extend through the outer sleeve, the holes being arranged to at least partially align with at least a portion of the plurality of inlet passages as the outer sleeve slides between the first position and the second position.

19. The gas turbine as in claim 18, wherein at least some of the holes have a non-circular shape.

20. The gas turbine as in claim 15, further comprising an actuating mechanism and a controller, wherein the outer sleeve is coupled to the actuating mechanism and the actuating mechanism is coupled to the controller.

* * * * *